United States Patent [19]

Satoh et al.

[11] Patent Number: 4,612,894

[45] Date of Patent: Sep. 23, 1986

[54] CONTROL SYSTEM FOR AN ENGINE HAVING AIR PASSAGE

[75] Inventors: Yoshihisa Satoh, Nagoya; Susumu Akiyoma, Kariya; Katsunori Ito, Aichi; Katsuhiro Ina; Masumi Kinugawa, both of Okazaki; Atsushi Suzuki, Oobu, all of Japan

[73] Assignee: Nippondenso Co., Ltd., Kariya, Japan

[21] Appl. No.: 791,526

[22] Filed: Oct. 25, 1985

[30] Foreign Application Priority Data

Oct. 26, 1984 [JP] Japan ..... 59-225324
Nov. 22, 1984 [JP] Japan ..... 59-247422

[51] Int. Cl.[4] ..... F02M 51/00
[52] U.S. Cl. ..... 123/494; 73/116
[58] Field of Search ..... 123/494, 464, 472, 478, 123/556, 588, 480; 73/116, 204

[56] References Cited

U.S. PATENT DOCUMENTS

| | | | |
|---|---|---|---|
| 1,260,498 | 3/1918 | Wilson | 73/204 |
| 2,943,614 | 7/1960 | Bosch et al. | 123/494 |
| 3,747,577 | 7/1973 | Mauch et al. | 123/494 |
| 3,796,198 | 3/1974 | Mauch et al. | 123/494 |
| 3,975,951 | 8/1976 | Kohama et al. | 123/494 |
| 4,051,818 | 10/1977 | Volckers | 123/494 |
| 4,133,326 | 1/1979 | Cops et al. | 123/494 |
| 4,334,186 | 6/1982 | Sasayama et al. | 123/494 |
| 4,404,846 | 9/1983 | Yamauchi et al. | 123/494 |

*Primary Examiner*—Raymond A. Nelli
*Attorney, Agent, or Firm*—Cushman, Darby & Cushman

[57] ABSTRACT

An engine control system has a heater and a temperature measuring element with a temperature-resistance characteristic. The heater and element are provided in the intake pipe of an engine. Heating, which initiated by a start pulse signal generated by an engine control unit in synchronism with engine rotation is supplied to the heater through a transistor. When the heater temperature has reached a reference temperature preset in accordance with the intake air temperature measured by the element, a comparator generates an output to deenergize the heater. The period of supplying the heating power is represented by a pulse signal from a flip-flop. This pulse signal is supplied as an airflow measurement signal to the engine control unit. The engine control unit calculates the basic fuel injection quantity and determines if the starting of the pulse signal received by the control unit falls within a predetermined period from the starting of the start pulse signal. If the starting has fallen outside the predetermined period, the output signal is considered to have been generated in response to a noise signal. In this case, a normal output signal next to the output signal generated in response to the noise signal is corrected.

9 Claims, 11 Drawing Figures

FIG. 1
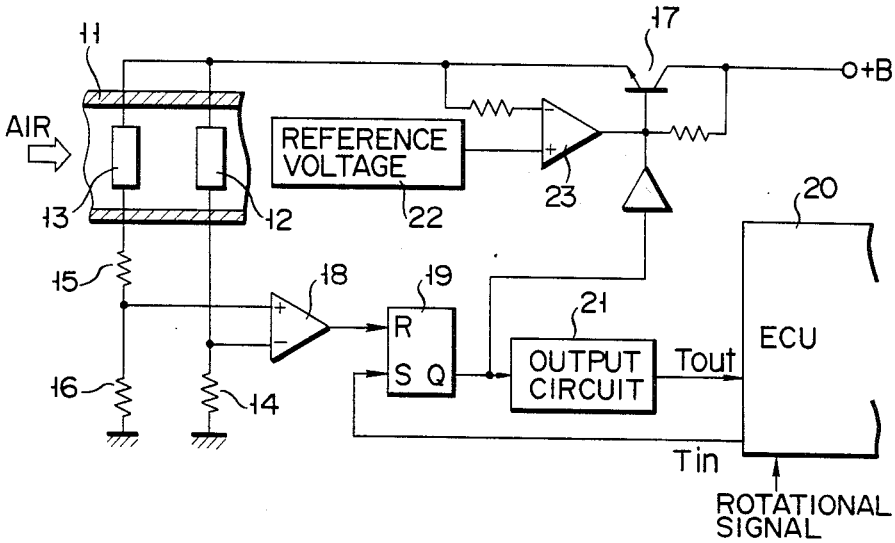
FIG. 2A
FIG. 2B
FIG. 2C
FIG. 2D
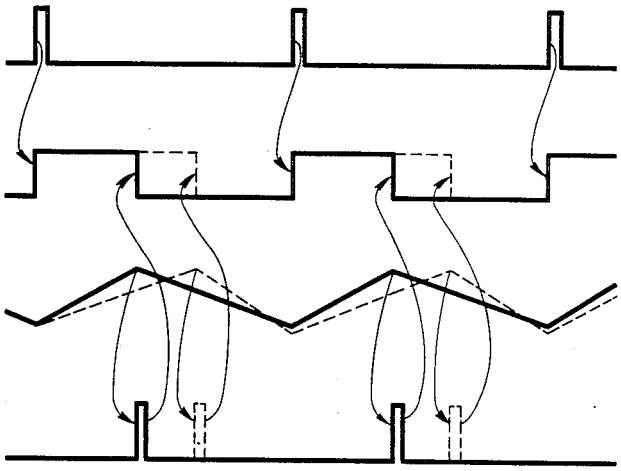

FIG. 3A
FIG. 3B
FIG. 3C
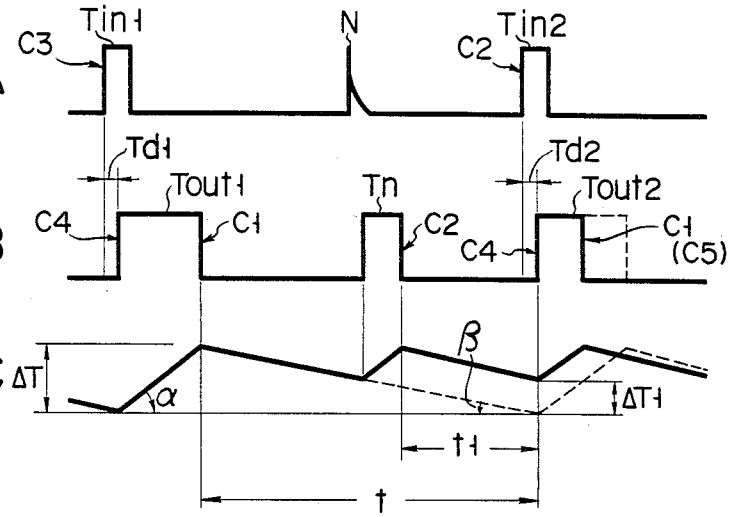
FIG. 4
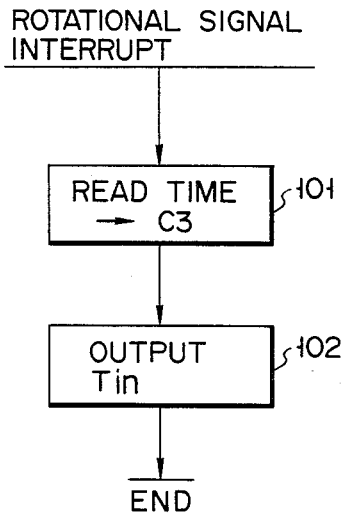
FIG. 5
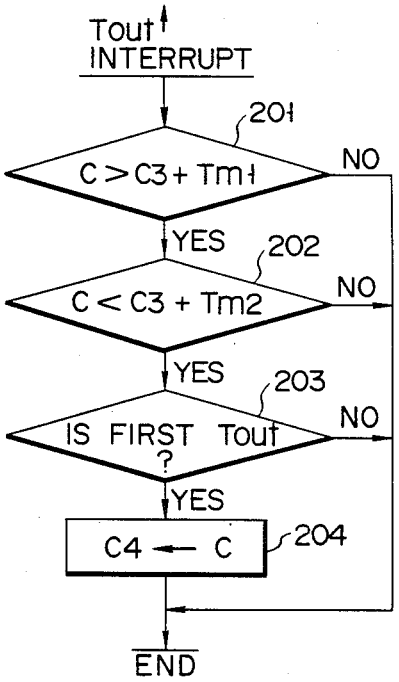

CONTROL SYSTEM FOR AN ENGINE HAVING AIR PASSAGE

BACKGROUND OF THE INVENTION

The present invention relates to a control system for an engine having an intake air passage and, more particularly, to a control system having a device which measures intake airflow and which can effectively detect an operating state of the engine and can electronically control the air/fuel ratio of the engine.

To electronically control an engine, the engine operating state is monitored, and a signal corresponding to the monitored operating state is generated. A suitable fuel injection quantity and a proper ignition timing are calculated in accordance with this signal. Fuel injection control and ignition timing control are performed in accordance with the calculated results.

An engine operating state monitoring means comprises an engine speed sensor, a cooling water sensor, a throttle valve opening sensor and the like. An intake airflow measuring device is used to calculate a basic fuel injection quantity.

A typical example of the intake airflow measuring device is the heat wire type airflow measuring device disclosed in Japanese Patent Disclosure No. 55-98621. This device utilizes heat dissipation effect of airflow. It has a heater with a temperature-resistance characteristic providing a resistance corresponding to a temperature, which is arranged in the intake manifold. Heating power is supplied to the heater to monitor changes in temperatures. More specifically, terminal voltage at the heater is compared with a reference voltage. The heating power supplied to the heater is fed back to the heater such that the heater temperature is kept equal to the specific temperature.

Since the heating power supplied to the heater is controlled such that the heater temperature is kept equal to the predetermined temperature, the output changes only by a factor of 2 even if the airflow changes to a value 100 times the original value. Therefore, the measuring sensitivity of the intake airflow is very low.

In order to supply intake airflow measurement data to the electronic engine control unit from such an intake airflow measuring device to achieve proper engine control, an offset processor must be added to an amplifier for amplifying the airflow detection signal, resulting in a complex circuit arrangement.

When an engine control unit includes a microcomputer, the output signal from the airflow measuring device must be a digital signal. When the airflow measurement signal consists of analog data, e.g., a current, a high-performance A/D converter must be used to convert this analog data to digital data. When the heater temperature is maintained at a given temperature by supplying pulsed heating power in an intermittent manner, the intake airflow can be detected by the pulse duty. In this case, however, a complex signal processing means is required for processing and calculating the pulse duty.

SUMMARY OF THE INVENTION

It is an object of the present invention to provide an engine control system for measuring the flow rate of air supplied to an engine in a satisfactory state, for generating an output signal most suitable for use in an electronic control unit incorporating a microcomputer and the like, and for effectively performing calculation control of, e.g., the fuel injection quantity.

It is another object of the present invention to provide an engine control system for eliminating erroneous output signals corresponding to noise signals so as to improve and stabilize engine control reliability when the output from the intake airflow measuring device includes a signal component based on a noise signal contained in a measurement instruction signal.

It is still another object of the present invention to correct an output signal influenced by a noise signal if any, as described above, and to couple a high-precision signal corresponding to the intake airflow to the engine control unit.

In an engine control system according to the present invention, a heater with a temperature dependent resistance characteristic is arranged in an intake pipe of an engine, and heating power is supplied to the heater. This power begins in response to a start pulse signal cyclically generated in synchronism with engine rotation. The heater is heated by the heating power. When the temperature of the heater has reached the reference temperature, heating power is withdrawn from the heater. A pulse signal representing a pulse width of the heating power is detected as an intake airflow measurement signal. But, if a noise signal is mixed with the start pulse signal, the heating power may be initiated by this noise signal. The time interval of the output signal corresponding to the normal start pulse generated next to the erroneous output signal generated in response to the noise signal is corrected in accordance with a time interval between the starting time of the output signal generated in response to the noise signal and the timing of the next normal start pulse signal.

When a noise signal is mixed with the start pulse signal and the heater is heated in response to the noise signal, the time interval represented by the output signal corresponding to the normal start pulse signal next to the noise signal is shortened and represents a smaller airflow rate as compared with the actual flow rate. The time interval represented by the normal output signal is influenced in correspondence with the time interval between the heating end time of the heater generated by the noise signal and the normal start pulse signal. Therefore, the time interval of the normal output signal is properly corrected and the fuel injection quantities for the engine are accurately calculated so that the engine can be electronically controlled in a stable manner.

BRIEF DESCRIPTION OF THE DRAWINGS

FIG. 1 is a circuit diagram for an engine control system, especially an intake airflow measuring device for measuring a flow rate of air supplied to an intake pipe, according to an embodiment of the present invention;

FIGS. 2A to 2D are respectively timing charts for explaining the operation of the intake airflow measuring device shown in FIG. 1;

FIGS. 3A to 3C are respectively timing charts for explaining the operation of the intake airflow measuring device when a noise signal is mixed with a start pulse signal for instructing measurement;

FIG. 4 is a flow chart for explaining an interrupt routine in synchronism with engine rotation in the intake airflow measuring device;

FIG. 5 is a flow chart for explaining an interrupt routine corresponding to the starting time of the output signal from the intake airflow measuring device.

DETAILED DESCRIPTION OF THE PREFERRED EMBODIMENT

Figure 6:
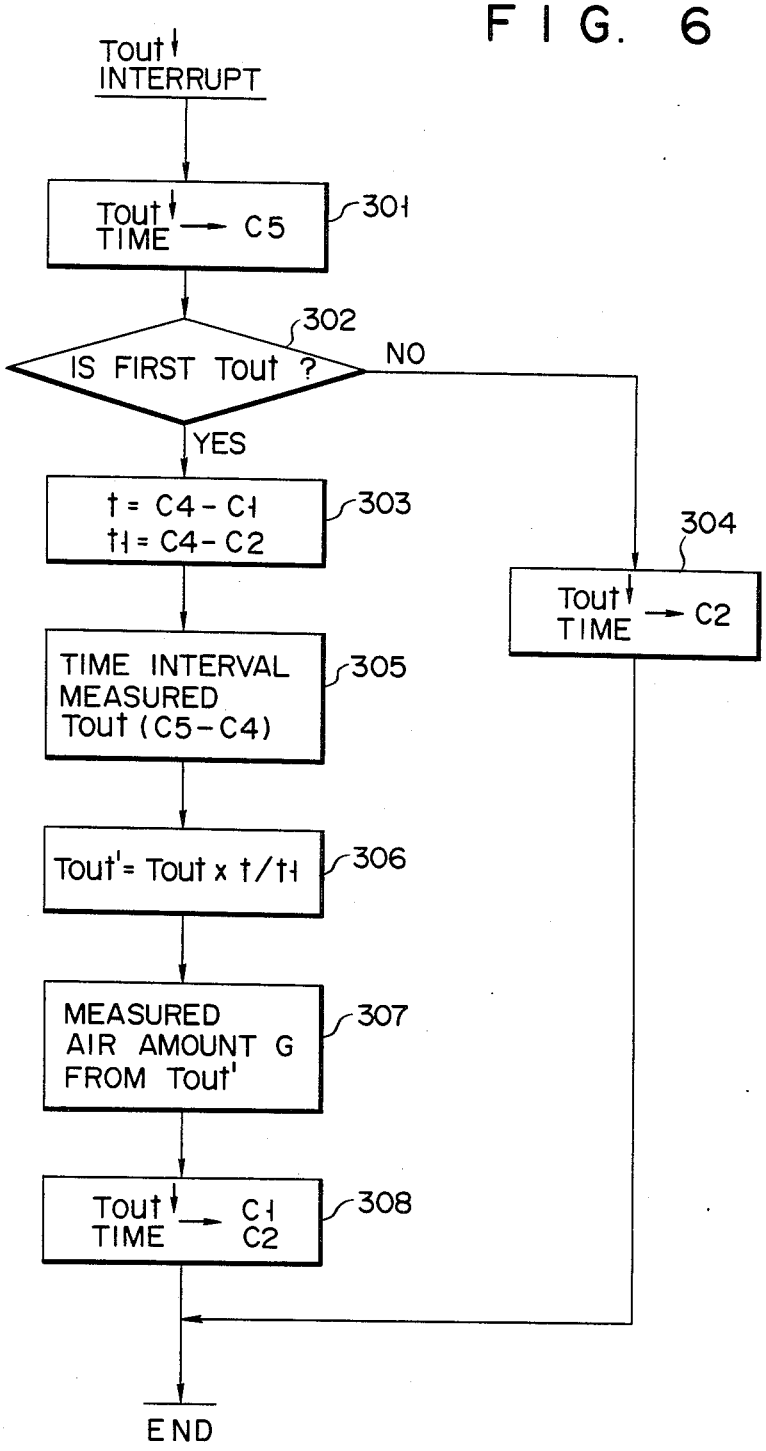
FIG. 6 is a flow chart for explaining an interrupt routine corresponding to the ending time of the output signal.

FIG. 1 shows a device for measuring the flow rate of air supplied to an intake pipe 11 for supplying combustion air to an engine. A heater 12 and a temperature measuring element 13 are arranged in the pipe 11. The heater 12 and the element 13 comprise resistors such as platinum wires each having temperature-resistance characteristics for determining a resistance in accordance with a change in temperature. The heater 12 and the element 13 are exposed to the intake airflow in the pipe 11. The heater 12 has a heat dissipation characteristic for dissipating heat by the intake airflow. The element 13 has a resistance corresponding to the temperature of the intake air.

The heater 12 is grounded through a fixed resistor 14. The element 13 is grounded through a series circuit of resistors 15 and 16. The heater 12, the element 13 and the resistors 14 to 16 constitute a bridge circuit. A junction between the heater 12 and the element 13 is connected to a power source voltage +B through a transistor 17.

The potential at junction a (the output terminal of the bridge circuit) between the heater 12 and the resistor 14 and the potential at a junction b between the resistors 15 and 16 are compared by a comparator 18. When the potential at the junction a is lower than that at the junction b, an output signal from the comparator 18 is set at the high level. In other words, when the temperature of the heater 12 is higher by a specific temperature difference than the temperature of the intake air detected by the element 13, the comparator 18 generates a signal of high level. The signal of high level resets a flip-flop 19.

The flip-flop 19 is set in response to a start pulse signal Tin from an engine control unit 20. The start pulse signal is generated in response to each signal representing every 180 degrees CA of engine rotation. The flip-flop 19 is set in synchronism with every 180-degree revolution of the engine. A pulse signal generated in response to the set/reset operation of the flip-flop 19 is supplied as an airflow measurement signal to the unit 20 through an output circuit 21. The pulse signal is also supplied to the base of the transistor 17. When the flip-flop 19 is held in the set state, the transistor 17 is turned on and heating power is supplied to the bridge circuit including the heater 12.

In this case, the voltage of the heating power supplied to the heater 12 through the transistor 17 is compared by an OP amplifier 23 with a reference voltage from a reference voltage source 22. A base bias voltage of the transistor 17 is controlled by an output signal from the amplifier 23. In other words, the heating power supplied to the heater 12 is controlled to be equal to the reference voltage.

When the signal Tin is generated by the unit 20 in synchronism with engine rotation, as shown in FIG. 2A, the flip-flop 19 is set in response to the start pulse signal. The output signal from the flip-flop 19 rises, as shown in FIG. 2B. The transistor 17 rises in response to the start pulse signal, and heating power is supplied to the heater 12.

When heating power is supplied to the heater 12, the heater 12 is heated and its temperature is increased, as shown in FIG. 2C. When the temperature of the heater 12 has reached a temperature higher by a specific temperature difference than the temperature of the intake air detected by the element 13, the potential at the junction a of the bridge circuit is lower than that at the junction b, so that the output signal from the comparator 18 is generated, as shown in FIG. 2D and hence the flip-flop 19 is reset (FIG. 2B). When the flip-flop 19 is held in the reset state, the transistor 17 is turned off and the heater 12 is deenergized. The temperature of the heater 12 is decreased, and the heater 12 awaits the next start pulse signal of the heating cycle.

When the constant voltage-controlled heating power is supplied to the heater 12 in response to the start pulse signal, the temperature of the heater 12 is increased in a heat dissipation state of the heater 12, i.e., in the state corresponding to the flow rate of air flowing through the pipe 11. More particularly, when the flow rate of intake air is large, the temperature rise rate of the heater 12 is decreased. The temperature rise characteristics are thus determined by the intake airflow. Therefore, a time interval between the set mode and the next reset mode of the flip-flop 19, that is, a supply time interval of heating power to the heater 12 corresponds to the flow rate of intake air flowing through the pipe 11. The pulse width of the output pulse signal from the flip-flop 19 represents the intake airflow.

The circuit 21 supplies the signal from the flip-flop 19 to the unit 20 as an airflow measurement signal Tout. The unit 20 calculates an air quantity G/N per revolution of the engine in accordance with the air quantity G represented by the airflow signal and the engine speed N and calculates a basic fuel injection quantity in accordance with G/N. The unit 20 adds correction values corresponding to engine operation states such as a cooling water temperature and an air/fuel ratio to the basic fuel injection quantity and generates an actual fuel injection quantity, thereby controlling the opening time of the fuel injection valve and hence performing fuel injection control.

The engine intake airflow is measured in a state synchronized with engine rotation. In this case, when a noise signal is mixed with the start pulse Tin from the unit 20, the flip-flop 19 is set in response to the noise signal.

As shown in FIG. 3A, for example, when a noise signal N is mixed with the normal start pulse signals Tin1, Tin2, . . . synchronized with engine rotation, the flip-flop 19 is set in response to the signal N and heating power supplied to the heater 12 begins. As shown in FIG. 3B, output signals Tout1, Tout2, . . . Tn are generated in correspondence with the start pulse signals Tin1, Tin2, . . . and the noise signal N.

In this case, although omitted in the description of FIG. 2, the output signals (FIG. 3B) from the circuit 21 are delayed by time intervals Td1, Td2, . . . from the start pulse signals of FIG. 2A due to operation lag of circuit elements such as the filter circuit constituting the output circuit 21. The lag time is attributable to changes in ambient temperature and variations in circuit elements. However, the lag times Td1, Td2, . . . fall within the range of the specific time interval Tm1 to Tm2 from the rising time of the start pulse signal. The time intervals Tm1 and Tm2 are experimentally measured.

The unit 20 compares the ON timing of the start pulse signal Tin from the unit 20 with the starting time of the signal from the circuit 21. When the unit 20 determines that the starting time falls within the range of Tm1 to Tm2 from the ON timing of the start pulse signal, the signal from the circuit 21 is detected as a measurement signal generated in correspondence with the normal start pulse signal. Other signals including the normal signal are not used by the unit 20 since they are determined to be associated with noise signals.

As shown in FIG. 3A, when the noise signal N is mixed with the normal start pulse signals Tin1, Tin2, . . . , heating power having the time interval Tout1 (FIG. 2B) is supplied to the heater 12, and the temperature of the heater 12 is increased. After the heater 12 is deenergized, the temperature of the heater 12 is gradually decreased in accordance with its specific heat dissipation characteristics. When the heating power rises in response to the next start pulse signal, the temperature of the heater 12 rises again. When the noise signal N is not present, the temperature of the heater 12 is changed as indicated by the broken line of FIG. 3C. A temperature rise rate represented by $\alpha$ is determined by the flow rate of intake air flowing through the pipe 11. A temperature fall rate represented by $\beta$ is determined by the heat dissipation characteristics of the heater 12. When the noise signal N is not present, the next start pulse signal is generated when the heater 12 is cooled to a temperature representing a heating wait state.

When a noise signal N is generated after the start pulse signal Tin1 is generated and before the next start pulse signal Tin2 is generated, the flip-flop 19 is set in response to the noise signal N, and the heating power rises and is supplied to the heater 12. The temperature of the heater is increased before it decreases to the temperature of the heating wait state, as indicated by the solid line of FIG. 3C. When the temperature of the heater 12 is higher than the temperature of the intake air by the specific temperature difference, the comparator 18 generates an output signal which resets the flip-flop 19.

In this case, the time interval between the noise signal N and the next start pulse signal Tin2 is sufficiently shorter than the time interval between two successive normal start pulse signals. The heater 12 is heated in response to the next start pulse signal Tin2 before the temperature of the heater 12, heated in response to the output signal Tn corresponding to the noise signal, is sufficiently decreased. Therefore, the heater 12 is heated from a temperature higher than the normal temperature.

More particularly, the temperature of the heater 12 supplied with heating power generated in response to the start pulse signal Tin2 is higher than the normal temperature by $\Delta T1$ at the starting time of heating power. The heater 12 is heated from a high temperature state. For this reason, the supply time interval of heating power enabled in response to the start pulse signal Tin2, that is, the time interval represented by the output signal Tout2 is shorter than that representing the actual intake airflow.

A time interval between the fall timing of the output signal Tout1 generated in response to the start pulse signal Tin1 and the rise timing of the output signal Tout3 generated in response to the next start pulse signal Tin2 is given as t; a time interval between the ending time of the output signal Tn (i.e. an output corresponding to the last noise signal having a timing closest to that of the start pulse signal Tin2 when a plurality of noise signals are present) generated in response to the noise signal N and the starting time of the output signal Tout2 is given as t1; a temperature rise gradient ((heater 12 temperature rise component)/(heating time)) of the heater 12 is given as $\alpha$; a temperature fall gradient is given as $\beta$; and a temperature rise rate of the heater 12 in the normal operation is given as $\Delta T$. Under these conditions, the following equations are derived:

$$\Delta T - \Delta T1 = \beta t1$$

$$\Delta T = \beta t$$

and $$Tout2 = \Delta T - \Delta T1/\alpha$$

$$Tout1 = \Delta T/\alpha$$

In order to correct the output signal Tout2, having a shorter pulse width caused by the noise signal, so as to increase the pulse width to a value equal to that of the output signal Tout1, the pulse width of the output signal Tout2 must be multiplied with t/t1.

By such a correction operation, the intake airflow measurement signal representing a measuring error due to the presence of the noise signal can be properly corrected. The corrected signal can be used for processing by the unit 20. Therefore, a fuel injection quantity suitable to a given operating state of the engine can be accurately calculated.

A means for correcting an airflow measurement signal error caused by the noise signal will be described hereinafter.

FIG. 4 shows an interrupt (in response to an ignition signal) routine by an engine rotational signal so as to operate the intake airflow measuring device described above. In step 101, the ignition signal generated in synchronism with engine rotation is detected. For example, a generation timing C3 is read by a value of a free running counter C preset in association with the CPU constituting the unit 20. In step 102, the start pulse signal Tin is generated in response to the ignition signal.

When the start pulse signal Tin is generated, the flip-flop 19 is set, and the signal Tout is generated. The interrupt routine is started in response to the starting time of the signal Tout, as shown in FIG. 5.

In this routine, the CPU checks in step 201 whether or not the count of the counter C is larger than a value obtained by adding a lower limit Tm1 to the generation time C3 of the start pulse signal. The CPU checks in step 202 whether or not the count of the counter C is smaller than a value obtained by adding an upper limit Tm2 to C3. The lower and upper limits Tm1 and Tm2 indicate the range of lag times Td1 and Td2. An output signal generated between the times Tm1 and Tm2 after a start pulse signal is generated is regarded as a normal output signal obtained upon measuring operation started in response to the start pulse signal.

If NO in step 201 or 202, the output signal is determined as the signal Tn not generated in response to the normal start pulse signal but generated in response to the noise signal.

However, if YES in step 201 or 202, the output signal is determined to be generated in response to the normal start pulse signal. The flow advances to step 203. The CPU checks in step 203 whether or not the output signal is generated as the first output signal in the interrupt mode started with the rotational signal. However, if the CPU determines that the output signal is the second or subsequent signal, it determines that the output signal is generated in response to the noise signal even if the signal falls within the range of Tm1 to Tm2.

When the output signal is determined in steps 201 to 203 to be generated in response to the normal start pulse signal, an interrupt is generated in step 204. At the same time, the count of the counter C is stored as time C4 representing the starting time of the output signal.

FIG. 6 shows an interrupt routine of an interrupt generated in response to the ending time of the output signal Tout. The ending time is read as C5 from the count of the counter C in step 301. The CPU checks in step 302 whether or not the output signal is the first output signal generated in response to the immediately preceding normal start pulse signal. If YES in step 302, the flow advances to step 303. For example, when the output signal is determined as a second or subsequent signal following the output signal Tout1 after the start pulse signal Tin1 is generated in the same manner as in the output signal Tn of FIG. 3B, the flow advances to step 304.

In this state, the CPU determines that the ending time of the signal Tout in this routine is that of the signal Tn generated in response to the noise signal. The routine start time is detected and stored as C2 in step 304. The time C2 is updated every time the interrupt is generated. When the noise signal is not generated, the time C2 corresponds to C5. When the output signal Tn corresponding to the noise signal is present, as shown in FIG. 3B, C2 is given as the ending time of the signal Tn. Furthermore, when a plurality of noise signals are mixed between two successive start pulse signals and a plurality of output signals Tn are generated, the ending time C2 of the output signal corresponding to the last noise signal is stored.

In step 303, the time interval t between the starting time C4 of the output signal obtained from the flow of FIG. 5 and the ending time C1 of the immediately preceding output signal is calculated. In addition, in step 303, when the output signal Tn generated in response to the noise signal is present, the time interval t1 between the ending time C2 of the signal Tn and the time C4 is calculated. More specifically, when the interrupt routine is executed in response to the ending time of the output signal Tout2 shown in FIG. 3B, time C1 is the ending time of the output signal Tout1, and time C2 is the ending time of the noise signal Tn.

In step 305, the time interval (C5–C4) of the output signal Tout is calculated from the time C4 and the time C5 obtained in step 301. In step 306, the corrected output time interval Tout' is calculated in accordance with the time intervals t and t1 obtained in step 306.

In this case, when the output signal Tn corresponding to the noise signal is not present, C2 is equal to C1, so that "Tout'=Tout" is established.

In step 307, the intake airflow rate G is obtained in accordance with the time interval Tout' calculated in step 306, so that an air quantity G/N per engine revolution is calculated. The basic fuel injection quantity is then calculated in accordance with G/N. In step 308, the Tout time is stored as C1 and C2.

The above correction operation is performed such that an output signal next to each noise signal is corrected. The influence of the noise signal may not be limited to the next output signal but may extend to the following normal output signals. By considering this influence, a plurality of output signals can be sequentially corrected when the noise signal is generated, thereby accurately measuring the intake airflow with high precision. Then, the engine can be stably controlled with higher reliability.

What is claimed is:

1. A control system for an engine having an intake air passage, comprising:

means for generating a first pulse signal;

means disposed in said air intake passage for generating heat in accordance with an electric power supplied thereto;

means for comparing the temperature of said heat generating means with reference temperature;

means for generating a second pulse signal starting in response to the first pulse signal and ending in response to an output of said comparing means indicating that the temperature of said heat generating means attains the reference temperature;

means for supplying said heat generating means with the electric power during a period of said second pulse signal;

means for measuring an interval of time from the starting of said first pulse signal to the starting of said second pulse signal;

time lag interval discriminating means for generating a discrimination signal when the interval of time measured by said time interval measuring means is shorter than a predetermined interval; and means for detecting an amount of air on the basis of the interval of time of said second pulse signal only when said time lag discriminating means generates the discrimination signal.

2. A system according to claim 1, further comprising means for correcting the detected amount of air by correcting the duration of the second pulse signal when another pulse signal has been generated before the second pulse signal, irrespective of the first pulse signal.

3. A system according to claim 2, wherein said air amount correcting means includes means for measuring the interval of time t1 between the starting edge of the second pulse signal and the ending edge of the other pulse signal, and corrects the duration of the second pulse signal in accordance with the interval of time t1.

4. A system according to claim 2, wherein said air amount correcting means includes means for calculating the interval of time t1 between the starting edge of the current second pulse signal in response to the first pulse signal and the ending edge of the other pulse signal generated from another pulse signal generated before the first pulse signal, and means for measuring the interval of time t between the starting edge of the current second pulse signal in response to the first pulse signal and the ending edge of another second pulse signal generated before the second pulse signal in response to another first pulse signal generated before the first pulse signal, thereby correcting the duration of the current second pulse signal in accordance with ratio of the interval of time t1 to the interval of time t.

5. A system according to claim 4, wherein said means for correcting the current second pulse signal comprises means for multiplying the interval of time of the current second pulse signal with the ratio.

6. A system according to claim 1, wherein the first pulse signal is generated in synchronism with the engine rotation.

7. A system according to claim 1, further comprising: an engine control unit for generating the first pulse signal in synchronism with the engine rotation, receiving the second pulse signal from second pulse signal generating means through an output circuit, and calculating a basic fuel injection quantity for the engine in accordance with a time interval signal represented by the second pulse signal and supplied from said output circuit.

8. A system according to claim 1, wherein the predetermined interval used in said time lag interval discriminating means is determined in correspondence with a possible interval of a time lag from the starting edge of the first pulse signal until the starting edge of the second pulse signal generated in response to the first pulse signal is supplied to said engine control unit.

9. A system according to claim 1, wherein the second pulse signal is discriminated to be generated in response to a noise signal mixed with the first pulse signal while the possible interval measured by said time interval comparing means is discriminated by said time lag interval discriminating means to be longer than the predetermined interval.

* * * * *